US007243726B2

(12) United States Patent
Ohmer

(10) Patent No.: US 7,243,726 B2
(45) Date of Patent: Jul. 17, 2007

(54) ENHANCING A FLOW THROUGH A WELL PUMP

(75) Inventor: Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 10/904,418

(22) Filed: Nov. 9, 2004

(65) Prior Publication Data

US 2006/0096760 A1 May 11, 2006

(51) Int. Cl.
*E21B 37/06* (2006.01)

(52) U.S. Cl. ..... 166/304; 166/312; 166/369

(58) Field of Classification Search ..... None
See application file for complete search history.

(56) References Cited

U.S. PATENT DOCUMENTS 4,637,469 A * 1/1987 Spriggs et al. ..... 166/310
4,665,981 A 5/1987 Hayatdavoudi
4,974,673 A 12/1990 Chacin U.
5,348,094 A 9/1994 Cholet et al.
5,431,222 A 7/1995 Bustamante
6,135,210 A * 10/2000 Rivas ..... 166/372
6,190,141 B1 2/2001 Henry
6,196,314 B1 3/2001 Chen
6,343,653 B1 2/2002 Mason et al.
6,531,694 B2 3/2003 Tubel et al.
6,533,039 B2 3/2003 Rivas et al.
2004/0043501 A1 3/2004 Means et al.
2004/0060703 A1 4/2004 Stegemeier et al.

FOREIGN PATENT DOCUMENTS

EP 1355169 A2 10/2003
WO WO98/57030 A1 12/1998

* cited by examiner

*Primary Examiner*—Frank Tsay
(74) *Attorney, Agent, or Firm*—Trop, Pruner & Hu, P.C.; Kevin B. McGoff; Bryan P. Galloway

(57) ABSTRACT

A method that is usable with a well includes injecting a chemical through a chemical injection line into a flow that passes through a well pump. The method includes controlling the injection of the chemical to enhance the flow through the pump.

61 Claims, 5 Drawing Sheets

ENHANCING A FLOW THROUGH A WELL PUMP

BACKGROUND

The invention generally relates to enhancing a flow through a well pump.

A growing number of oilfields are exposed to production decline problems. These decline problems may be attributable to the performance of downhole pumps, a performance that is a function of the well fluid mixture that is produced from the well. For example, the output of a pump, such as a submersible centrifugal pump, may depend on the gas-to-oil ratio of the well fluid mixture that flows through the pump. Although a small proportion of gas mixed into the well fluid mixture does not alter the output of the pump, the pump generally is significantly less efficient in pumping a well fluid mixture that has a larger proportion of gas. A large water-to-oil ratio in the well fluid mixture may present similar challenges. Additionally, the well fluid mixture may contain impurities that build up deposits, such as scale or tar, in a downhole pump over time, and these deposits may degrade the pump's performance.

Thus, there exists a continuing need for better ways to enhance the flow through a well pump and increase the overall efficiency and logetivity of the fluid lifting system.

SUMMARY

In an embodiment of the invention, a method that is usable with a well includes injecting a chemical through a chemical injection line into a flow that passes through a well pump. The method includes controlling the injection of the chemical to enhance the flow through the pump.

In another embodiment of the invention, a system that is usable with a well includes a pump that includes a motor and a reservoir to receive a lubricant for the motor. The system includes a mechanism to establish a bleed path between the reservoir and a well fluid flowpath of the pump to communicate the lubricant into the well fluid flowpath. As an example, the lubricant may be used to prevent erosion or corrosion in the pump.

Advantages and other features of the invention will become apparent from the following description, drawing and claims.

DETAILED DESCRIPTION

In accordance with some embodiments of the invention, one or more chemicals are added to a well fluid flow that passes through a well pump for purposes of enhancing the flow through the pump. The enhancement of the well fluid flow through the pump increases the pump's performance and may lead to significantly less accumulation of deposits, such as tar or scale, in the flowpath of the pump.

Figure 1:
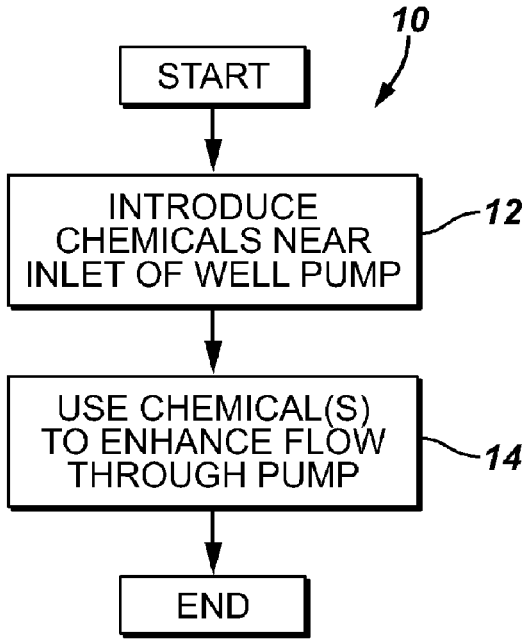
FIG. 1 is a flow diagram depicting a technique to enhance a flow through a downhole pump according to an embodiment of the invention.

Referring to FIG. 1, more particularly, in accordance with an embodiment of the invention, a technique 10 that is usable with a well includes introducing (block 12) one or more chemicals near the inlet of a well pump and using (block 14) the chemical(s) to enhance the well fluid flow through the pump. In certain conditions such as heavy oil lifting, the chemical injection may be located further upstream, at the end of a tail pipe.

In the context of the application, "well fluid flow" means a flow that contains either a single fluid (oil, for example) or a mixture (oil, water and/or gas, for example) of fluids that are produced from the well. Similarly, "well fluid" may refer either to a single fluid or a mixture of fluids that are produced from the well.

Thus, the chemical(s) that are introduced into the flow may be used for a variety of different functions to increase the performance of the pump, such as stabilizing a gas/liquid mix that is formed at the input stage of the pump. In some embodiments of the invention, the volumetric rate at which the chemical(s) are added may be relatively small, as compared to the volumetric rate at which well fluid moves through the pump.

Figure 2:
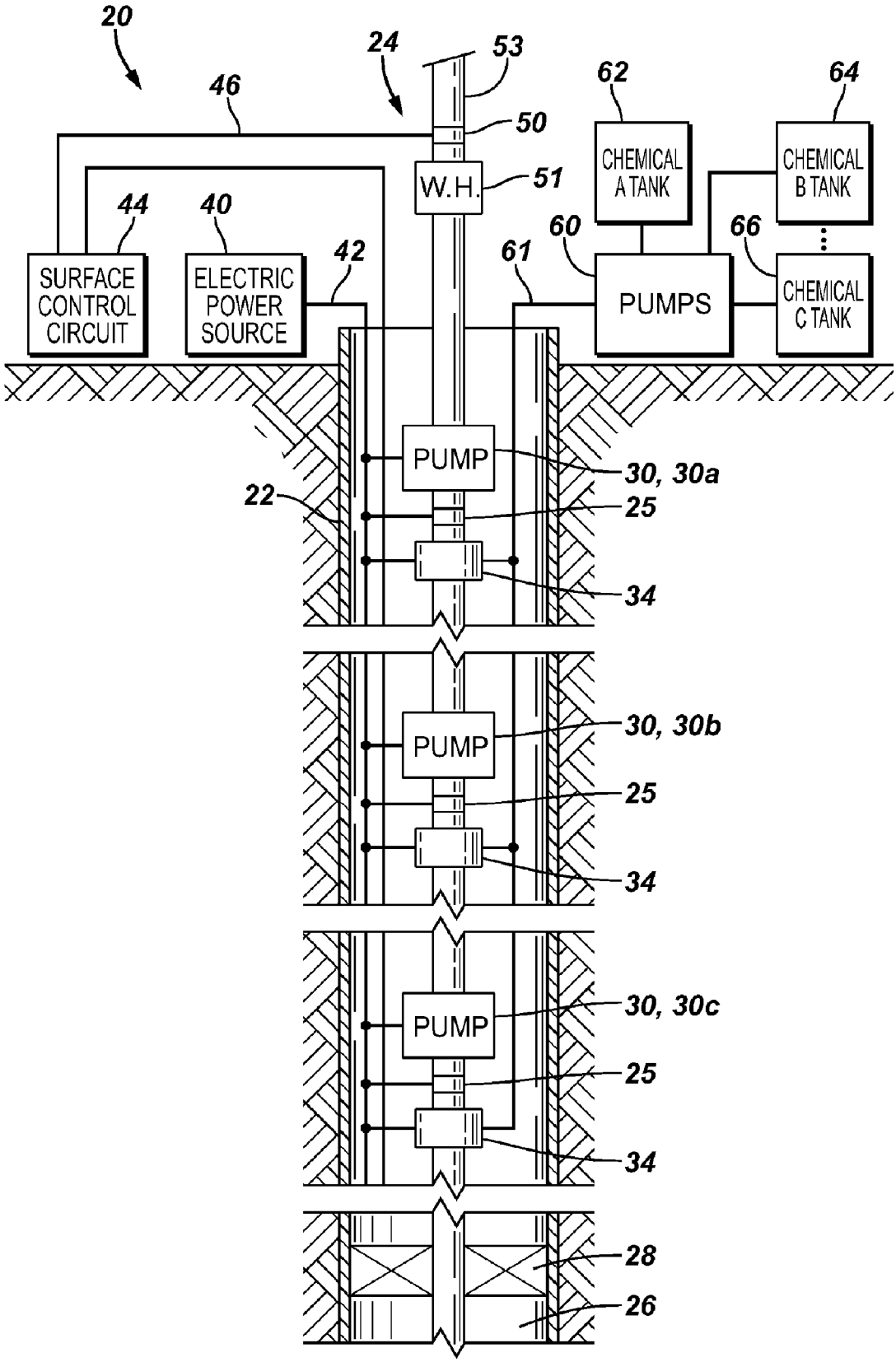
FIG. 2 is a schematic diagram of a subterranean well according to an embodiment of the invention.

As a more specific example, FIG. 2 depicts a subterranean well 20 in accordance with some embodiments of the invention. FIG. 2 depicts a non-subsea application. However, it is noted that the techniques that are described herein may extend to heavy oil pumping or flow boosters that are installed on the seabed to enhance flow into subsea flow lines or pipelines, as further described below.

For the embodiment that is depicted in FIG. 2, the well 20 includes a production tubing string 24 that extends into the well; and the tubing string 24 may include, for example, several pumps 30 (pumps 30*a*, 30*b* and 30*c*, depicted as examples) that may be used for purposes of pumping a production fluid from one or more production zones (such as a production zone 26 that is formed below a packer 28, for example) of the well. As an example, the pumps 30 may be submersible pumps (such as centrifugal pumps, or progressive cavity pumps for example), in some embodiments of the invention.

Although FIG. 2 depicts a vertical well bore, it is understood that one or more pumps may be located in lateral wellbores, in some embodiments of the invention. As depicted in FIG. 2, the production tubing string 24 may be surrounded by a casing string 22 of the well. However, in other embodiments of the invention, the production tubing string 24 may be used in an uncased well.

The pumps 30 and production tubing string 24 are part of a completion system for pumping production fluid from the well 20. For purposes of enhancing flow through the pumps 30, in accordance with an embodiment of the invention, the production tubing string 24 includes chemical injection units 34. Each chemical injection unit 34 may be associated with a particular pump 30 and is constructed (as described further below) to inject one or more chemicals upstream of the associated pump 30 near (within one foot, for example) the pump's well fluid inlet.

Figure 3:
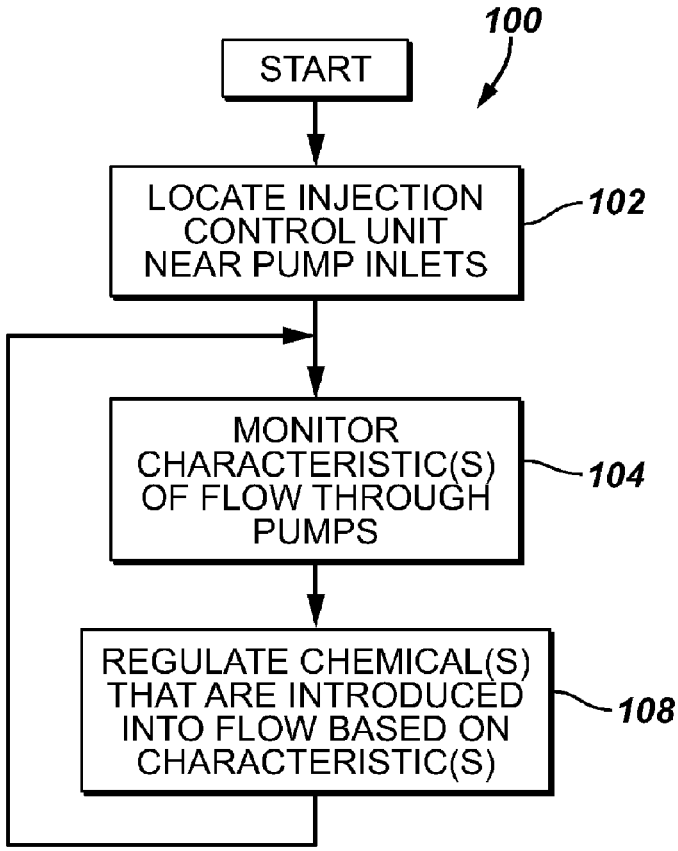
FIG. 3 is a flow diagram depicting a technique to regulate chemicals that are introduced into a well fluid flow according to an embodiment of the invention.

Referring also to FIG. 3, thus, in accordance with some embodiments of the invention, a technique 100 may be used to enhance the flow of production fluid through the pumps 30 of the well 20. Pursuant to the technique 100, chemical injection control units 34 are located near the well fluid inlets of the pumps 30, as depicted in block 102. Characteristics of the well fluid flow through the pumps 30 is monitored (block 104), and the introduction of chemicals into the flow near the inlets is regulated (block 108) based on the monitored characteristics for purposes of enhancing flow through the pumps 30.

The chemicals that are injected by the chemical injection units 34 may serve different functions for purposes of enhancing the flow through the associated pumps 30. For example, in some embodiments of the invention, a particular chemical injection unit 34 may introduce one of multiple chemicals into the well fluid inlet of the associated pump 30. Thus, one or more chemicals that are introduced by the associated chemical injection unit 34 may be directed to stabilizing a high gas/liquid mix in the well fluid flow through the pump, for example.

As a more specific example, the chemical injection unit 34 may introduce one or more chemicals to enhance or maintain flow by mitigating the following conditions: deposition of solid materials such as asphaltene, paraffin, and hydrate; formation of scales; or flow of heavy oil due to foam formation or increase in viscosity based on a change of temperature. Each of these conditions may result in the decrease of flow through the associated pumps 30 or system. The type of chemical used may vary based on the type of condition (paraffins, scales, etc.). The type of condition may be predicted by knowing the pressure and temperature in addition to the type of fluid flowing through the system. For instance, if the expected condition is asphaltenes, then the injected chemical may be highly aromatic compounds such as toluene, kerosene, or heavy naphtha. If the expected condition is paraffin, then the injected chemical may be xylene or toluene. If the expected condition is hydrate, then the injected chemical may be surfactants (poly vinyl caprolactum) or methanol. If the expected condition is scale, then the injected chemical may be EDTA (ethylene tetraacetic acid) or HCl (hydrochloric acid). If the expected condition is heavy oil (high viscosity), then the injected chemical may be drag reducers (specialty chemicals). And, if the expected condition is foam formation, then the injected chemical may be octyl alcohol, aluminum stearate, or other sulfonated hydrocarbons.

As a more specific example, the chemical injection unit 34 may introduce one or more tension-active chemical(s) that are combined with the well fluid flow upstream of the pump 30 via a mechanical mixer (as described further below) to stabilize an otherwise unstable flow while passing through the pump due to certain proportions of the various fractions that compose the produced fluid.

More generally then, the chemicals may be introduced to increase fluid mobility, increase fluid homogeneity through the pump by stimulating or stabilizing any emulsions present, prevent the formation of undesired deposits (such as hydrates, tars, parrafins, or scale) or corrosion along the flow pipe, or optimize the flow through the pump. The chemicals may also be introduced to avoid contamination of fluid filling the motor compartment, improve lubrication of the pump and motor, dramatically reduce the volumetric compensation requirement of the pump, or increase the life of the motor/pump dynamic seal by injecting a lubricant at the seal.

Referring to FIG. 2, in accordance with some embodiments of the invention, each chemical injection unit 34 may be connected to one or more chemical injections lines 61 that extend downhole from the surface of the well 20. As an example, each chemical injection line 61 may be associated with a different chemical (in some embodiments of the invention) and may be pressurized by an associated chemical pump 60 that is located, for example, at the surface of the well 20.

The chemical pumps 60 are connected to supply chemicals from various chemical supply tanks (such as chemical A supply tank 62, chemical B supply tank 64, chemical C supply tank 66, etc.) that are located at the surface of the well 20. In some embodiments of the invention, the same chemical may be supplied by multiple chemical supply lines 61 and/or multiple chemical supply tanks. Pumps and chemical tanks may be part of a sub-sea production support system located on the sea-bed or on a floating production facility unit.

For a particular pump 30, as further described below, a surface control circuit 44 (of the well 20), the chemical injection unit 34 or a combination of these entities may control which chemicals are injected into the flow through the pump 30, as well as control the volumetric rate at which the selected chemicals are injected into the flow through the pump 30.

The well 20 may have various other features, as depicted in FIG. 2, such as, for example, an electric power source 40 that is located at the surface of the well 20 for purposes of supplying power downhole to the pumps 30 and the chemical injection control units 34. The electric power source 40 may be electrically coupled to electrical power lines 42 that extend downhole to the pumps 30 and chemical injection control units 34. In some embodiments of the invention, the electrical power lines 42 and the chemical lines 61 may be bundled together in a rubber/plastic encapsulated flat pack that is secured to the outer surface of the production tubing string 24 by, for example, cable clamps, in accordance with some embodiments of the invention.

Among the other features of the production tubing string 24, in some embodiments of the invention, the tubing string 24 may include heater elements 25, each of which is associated with a particular pump 30 (as an example) and is located upstream of the pump 30 near the pump's inlet. The heater elements 25 may be coupled to the electrical power lines 42 for purposes of producing thermal energy and introducing this thermal energy into the flow through the associated pump 30 to establish an optimum temperature for the chemical additives to perform their function to the well fluid flow through the associated pump 30.

In some embodiments of the invention, the production tubing string 24 may include one or more sensors that are located near the surface of the well 20 and are coupled to a surface control circuit 44 that uses these sensors to monitor characteristics of the flow. Alternatively, as depicted in FIG. 2, in some embodiments of the invention, sensors 50 may be located in a pipeline 53 that is connected to a wellhead 51 (of the well 20) for purposes of monitoring one or more characteristics of the well fluid flow. Thus, many variations are possible and are within the scope of the appended claims.

The sensors 50 may include well fluid sample sensors, acoustic energy sensors, temperature sensors, pressure sensors, etc. The surface control circuit 44 may use the sensors 50 for purposes of detecting the composition and various other properties of the well fluid that flows through the pumps 30. Based on the monitored characteristics, the surface control circuit 44, in some embodiments of the invention, calculates, or determines, flow parameters and controls the actions of the chemical injection units 34 accordingly to regulate the injection of chemicals into the well fluid flowpaths of the pumps 30. As further described below, one or more of the chemical injection units 34 may also include sensors for purposes of supplementing or replacing the calculation of the flow parameters by the surface control circuit 44, depending on the particular embodiment of the invention.

Figure 4:
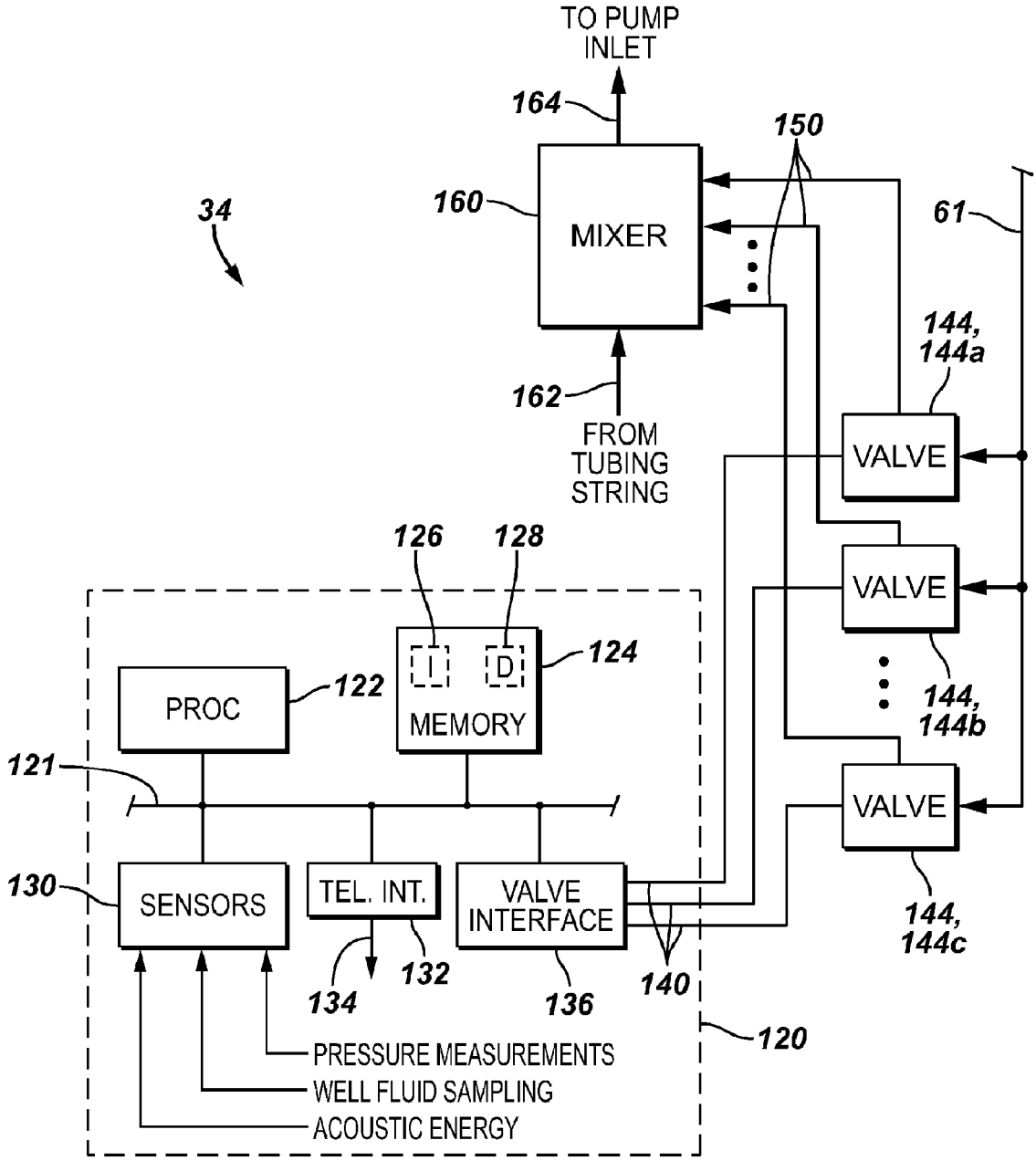
FIG. 4 is a schematic diagram of a chemical injection unit according to an embodiment of the invention.

Referring to FIG. 4, in some embodiments of the invention, the chemical injection unit 34 may include circuitry 120 to monitor one or more characteristics in the flow of production fluid through the chemical injection unit 34 (and thus, through the associated pump 30). For example, in some embodiments of the invention, the circuitry 120 may include one or more sensors 130 for purposes of sensing such parameters as acoustic energy, well fluid composition, pressure measurements, temperature measurements, etc. for purposes of determining one or more characteristics of the well fluid flow through the pump 30. From these characteristics, in some embodiments of the invention, a processor 122 of the circuitry 120 determines one or more flow parameters that characterize the flow.

In some embodiments of the invention, the processor 122 may communicate via telemetry lines 134 (as an example) with the surface control circuitry 44 (see FIG. 2) for purposes of communicating the monitored characteristics to the surface control circuit 44. Thus, in these embodiments of the invention, the surface control circuit 44 may determine one or more flow parameters that characterize the well fluid flow near the injection unit 34 and then communicate via the telemetry lines 134 to the injection control unit 34 to control the unit 34. Alternatively, in some embodiments of the invention, the surface control circuit 44 may communicate monitored characteristics (obtained via the sensors 50 (see FIG. 2)) to the processor 122 via the telemetry interface 132 for purposes of allowing the processor 122 to calculate or determine the flow parameters. Thus, many variations are possible and are within the scope of the appended claims.

Figure 5:
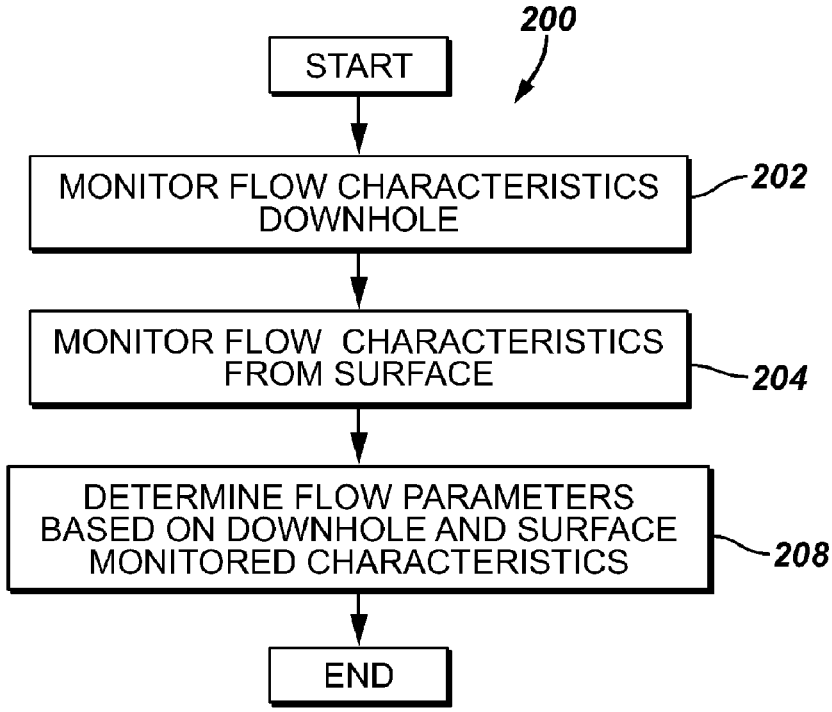
FIG. 5 is a flow diagram depicting a technique to determine flow parameters according to an embodiment of the invention.

Regardless, however, of the particular procedure used, in some embodiments of the invention, the circuitry 120 of the chemical injection unit 34 and the surface control circuit 44 may interact together to perform a technique 200 that is depicted in FIG. 5. Pursuant to the technique 200, flow characteristics are monitored downhole (block 202); flow characteristics are monitored from the surface, in accordance with block 204; and flow parameters are then determined (block 208) based on the monitored downhole and surface characteristics. It is noted that in some embodiments of the invention, only the surface or only the downhole characteristics may be used for purposes of calculating the flow parameters. Thus, many variations are possible and are within the scope of the appended claims.

As depicted in FIG. 4, in some embodiments of the invention, the processor 122, sensors 130 and telemetry interface 132 may all communicate over a system bus 121 of the chemical injection control unit 34. The processor 122 represents, for example, one or more microprocessors or one or more microcontrollers, depending on the particular embodiment of the invention. The circuitry 120 may also include, for example, a memory 124 for purposes of storing instructions 126 to cause the processor 122 (and thus the chemical injection control unit 34) to perform one or more of the techniques that are described herein. Furthermore, the memory 124 may store data 128, such as data collected by the sensors 130, calculated flow parameters, etc., depending of the particular embodiment of the invention. The memory 124 communicates with the processor 122 over the system bus 121.

In some embodiments of the invention, the circuitry 120 controls the chemicals that are mixed into the flowpath of the associated pump 30, as well as the rate at which the chemicals are injected into the flowpath. For purposes of performing this function, the circuit 120 includes a valve interface 136 that is coupled to the system bus 121. As a more specific example, the valve interface 136 may include, for example, one or more solenoid control circuits for purposes of selectively turning on and off solenoid valves 144 (valves 144*a*, 144*b*, and 144*c*, depicted as examples). Each valve 144, in turn, may be coupled to a respective chemical line 61 for purposes of selectively establishing communication between the line 61 and a mixer 160. The mixer 160 is connected into the well fluid flowpath of the pump 30 and is upstream of the pump's well fluid inlet. Valves other than solenoid valves may be used in other embodiments of the invention.

In some embodiments of the invention, the processor 122, through the valve interface 136, controls the open and closed states of each of the valves 144 for purposes of regulating when a particular valve 144 introduces (via its outlet 150) a particular chemical into the mixer 160. As a more specific example, in some embodiments of the invention, the processor 122 may regulate the rate at which a particular valve 144 introduces a particular chemical into the mixer 160 by regulating the cross-sectional open flowpath of the valve 144. Thus, in some embodiments of the invention, each valve 144 may be a variable control valve.

However, in other embodiments of the invention, each of the valves 144 may have, for example, a fixed open cross-sectional flowpath. In these embodiments of the invention, the processor 122 may, through the valve interface 136, modulate the open and closed duty cycle of a particular valve 144 to control a rate of fluid flow through the valve 144. Thus, many variations are possible and are within the scope of the appended claims.

The mixer 160 has an inlet 162 that receives a flow of production fluid from the production tubing string 24 upstream of a mixing chamber of the mixer 160. The mixer 160 also includes an outlet 164 that is downstream of the mixing chamber of the mixer 160 and upstream of the inlet of the associated pump 30. As its name implies, the mixer 160 in its mixing chamber, mixes the production fluid with the chemicals that are introduced by the valves 144 at their respective outlets 150 into inlet ports of the mixer 160.

Figure 6:
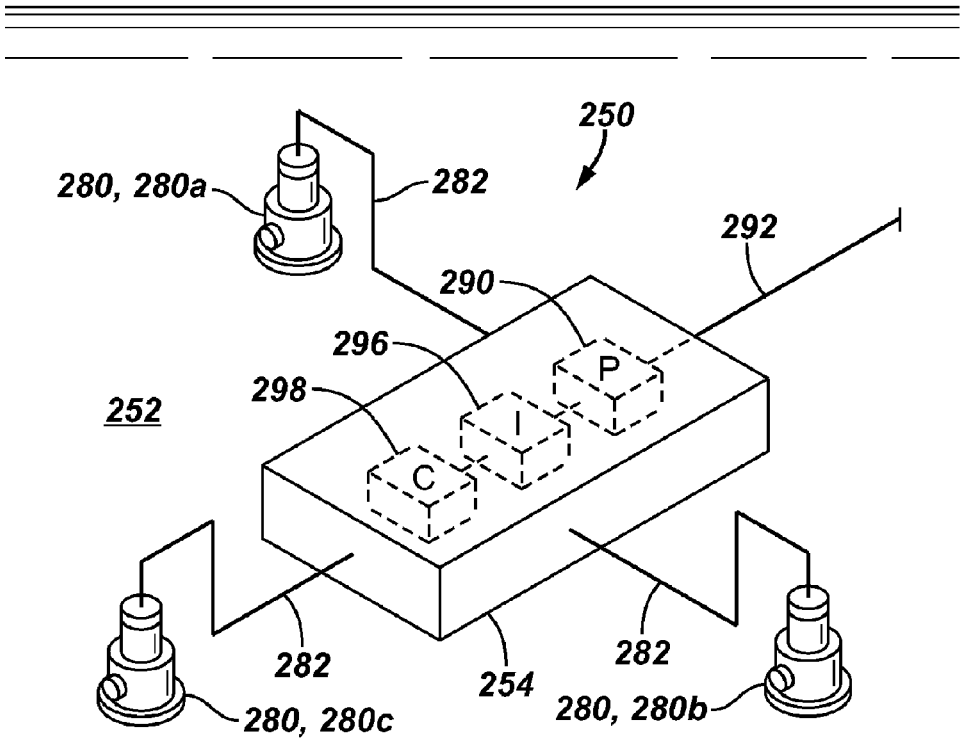
FIG. 6 is an illustration of a subsea well field according to an embodiment of the invention.

Other embodiments are within the scope of the appended claims. For example, referring to FIG. 6, in some embodiments of the invention, the techniques that are disclosed herein may be used in connection with a subsea well field 250. The well field 250 includes several well trees (well trees 280*a*, 280*b* and 280*c*, depicted as examples), each of which is associated with a subsea well. Each of the well trees 280 is coupled to a respective production fluid outlet line 282. The outlet lines 282, in turn, are coupled to a flow booster 254 that is located on the sea floor 252. The flow booster 254 includes one or more pumps 290 that mix the well fluid from the various wells and pump the mixed fluid into a line 292 that extends to another flow booster, to a sea platform, etc., depending on the particular embodiment of the invention.

The flow booster 254 includes a chemical injection unit 296 that injects fluids near (within one foot, for example) and upstream of inlets of the pumps 290. The flow booster 254 also includes a circuit 298 that senses one or more characteristics of the fluid and controls the chemical injection unit 296 accordingly, similar to the other techniques disclosed herein.

Figure 7:
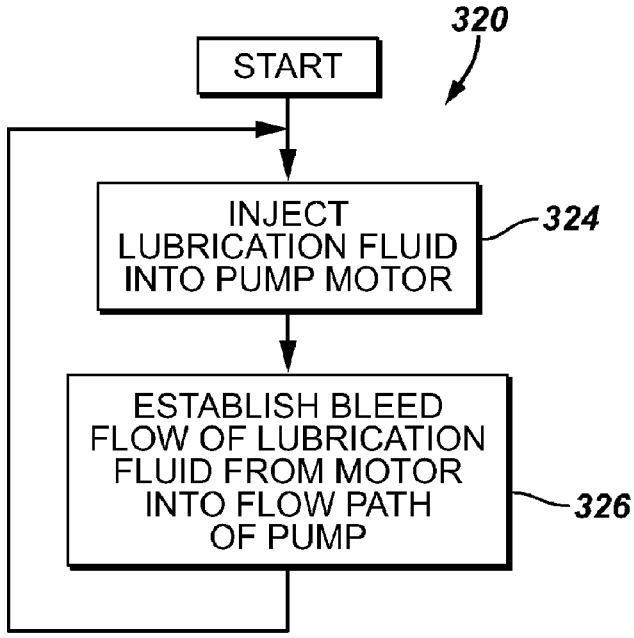
FIG. 7 is a flow diagram depicting a technique to bleed pump motor lubricant into a well fluid flowpath according to an embodiment of the invention.

As an example of another embodiment of the invention, FIG. 7 depicts a technique 320 that illustrates how chemicals may be added to the well fluid flowpath of the pump by ways other than by directly injecting a chemical from a chemical supply line. For example, according to the technique 320, a lubrication fluid is injected (block 324) into a pump motor. Thus, the pump may be a submersible pump, similar to the pumps that are disclosed above. The lubrication fluid, as its name implies, lubricates moving parts of the motor. However, the lubrication fluid may have the dual purpose of inhibiting corrosion in the pump. Thus, in accordance with the technique 320, a bleed flow of the lubricant fluid is established (block 326) from the motor into the flowpath of the pump. Thus, fluid is continually injected into the pump motor, while a bleed flow establishes a flow into the pump for purposes of inhibiting corrosion.

Figure 8:
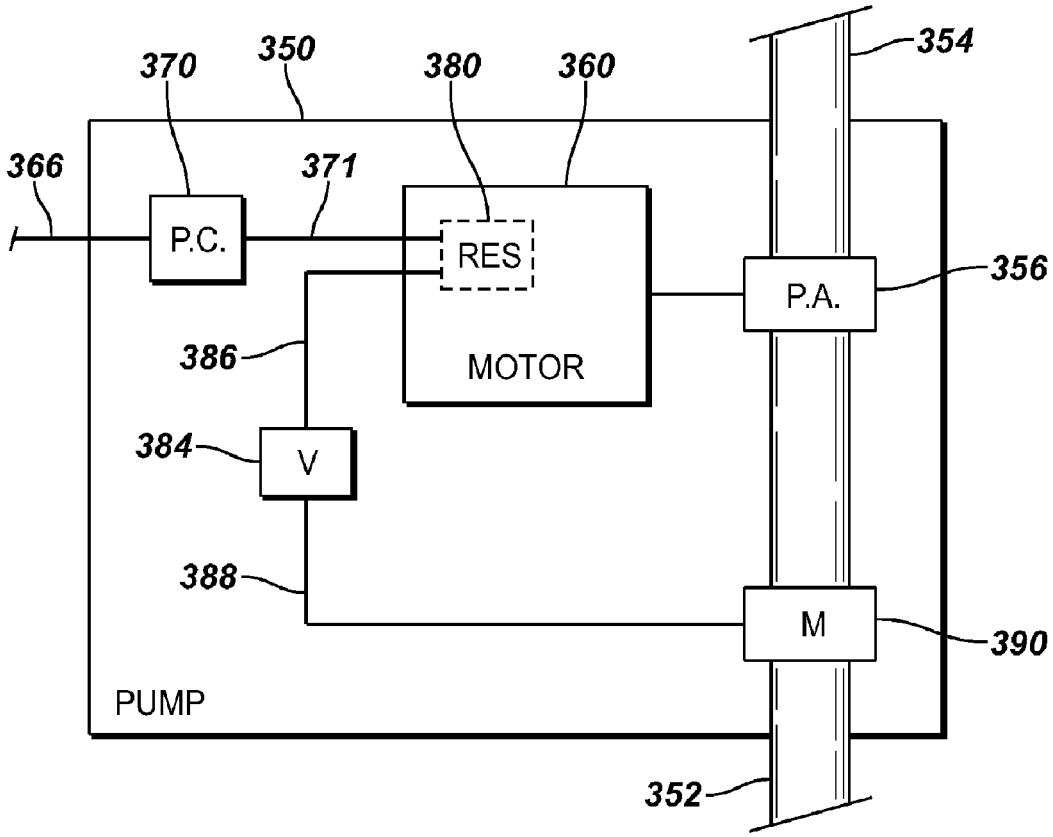
FIG. 8 is a schematic diagram of a well pump according to an embodiment of the invention.

As a more specific example, FIG. 8 depicts a pump 350 in accordance with an embodiment of the invention. The pump 350 includes an inlet 352 for purposes of receiving a flow of well fluid. A pump actuator 356 is located in a flowpath between the pump inlet 352 and a pump outlet 354. The pump actuator 356 is driven by a motor 360 of the pump 350 for purposes of pumping the fluid through the pump 350. Also located in this flowpath between the pump inlet 352 and outlet 354 is a mixer 390.

The mixer 390 is connected to an outlet 388 of a bleed valve 384. An inlet 386 of the bleed valve 384, in turn, is coupled to a lubrication fluid reservoir 380 of the motor 360. The reservoir 380 contains lubrication fluid that lubricates moving parts of the motor 360 and receives the lubrication fluid through an outlet 371 of a pressure compensator 370. The pressure compensator 370, in turn, includes an inlet 366 that is connected to a lubrication fluid supply line. For example, in some embodiments of the invention, the lubrication fluid inlet 366 may be connected to one of the chemical lines 61 (a dedicated lubrication fluid line, for example) depicted in FIG. 2.

Thus, the pressure compensator 370 of the pump 350 establishes a positive pressure on the reservoir 380 to keep the lubrication fluid inside the motor 360 at this constant pressure. The bleed valve 384 establishes a bleed flowpath to the well fluid flowing through the pump 350. Because the pressure compensator 370 maintains a constant pressure in the reservoir 380, the pressure compensator 370 establishes a bleed flow of lubrication fluid into the reservoir 380 to maintain a sufficient level of fluid pressure inside the motor 360. As an option the bleed valve can be associated with a pressure sensor that measures the real-time pressure inside the motor. Processing of this data combined with flow of supplied at surface may indicate abnormal actions in order to prevent catastrophic failure of the pump. Other variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

injecting a chemical through a chemical injection line into a well fluid flow that passes through a well pump; and controlling the injecting to enhance the flow when passing through the pump, including controlling the injecting to reduce instability of a well mixture flowing through the pump caused by a gas-to-liquid ratio of the mixture.

2. The method of claim 1, wherein the injecting comprises injecting the chemical upstream a well fluid inlet of the pump.

3. The method of claim 1, wherein the controlling comprises controlling the injecting to reduce dynamic viscosity of a petroleum liquid phase of a well fluid mixture flowing through the pump.

4. The method of claim 1, wherein the controlling comprises controlling the injecting to inhibit the formation of a product in the pump.

5. The method of claim 4, wherein the product comprises at least one of tar and scale.

6. The method of claim 1, further comprising:

selecting the chemical from multiple different chemicals.

7. The method of claim 1, further comprising:

monitoring a flow through the pump, wherein the controlling occurs in response to the monitoring.

8. The method of claim 7, wherein the monitoring occurs near the surface of the well.

9. The method of claim 7, wherein the monitoring occurs near the pump.

10. The method of claim 7, wherein the monitoring occurs near the surface of the well and near the pump.

11. The method of claim 7, wherein the monitoring comprises monitoring a flow exiting the pump.

12. The method of claim 7, wherein the monitoring comprises:

calculating at least one flow parameter of the flow.

13. The method of claim 1, wherein the controlling occurs entirely downhole.

14. The method of claim 1, wherein the controlling comprises communicating between circuitry near the pump and circuitry near the surface of the well.

15. The method of claim 1, wherein the well comprises a well beneath a seabed.

16. The method of claim 1, wherein the chemical comprises a tension-active chemical, the method further comprising:

using a mechanical mixer upstream of the pump to mix the tension-active chemical into the well mixture.

17. A system usable with a well, comprising:

a pump to establish a flow through the well;

a chemical injection line to inject a chemical into the flow upstream of the pump; and a circuit to control the injection of the chemical to enhance a flow through the pump, wherein the circuit controls the injection to reduce instability of a well mixture flowing through the pump caused by a gas-to-liciuid of the mixture.

18. The system of claim 17, wherein the chemical injection line injects the chemical near a well fluid inlet of the pump.

19. The system of claim 17, wherein the circuit controls the injection to reduce dynamic viscosity of a petroleum liquid phase of a well fluid mixture flowing through the pump.

20. The system of claim 17, wherein the circuit controls the injection to inhibit the formation of a product in the pump.

21. The system of claim 20, wherein the product comprise at least one of tar and scale.

22. The system of claim 17, further comprising:
multiple chemical sources; and
a mechanism to select the chemical from the multiple chemical sources.

23. The system of claim 17, wherein the circuit comprises at least one sensor to monitor a flow through the pump, and the circuit controls the injection in response to the monitoring of the flow.

24. The system of claim 23, wherein the circuit is located near the surface of the well.

25. The system of claim 23, wherein the circuit is located near the pump.

26. The system of claim 23, wherein the circuit is located near the surface of the well and near the pump.

27. The system of claim 23, wherein the circuit monitors a flow exiting the pump.

28. The system of claim 23, wherein the circuit calculates at least one flow parameter of the flow.

29. The system of claim 17, wherein the circuit is located entirely downhole.

30. The system of claim 17, wherein the circuit is located near the pump and near the surface of the well.

31. The system of claim 17, further comprising:
a mechanical mixer upstream of the pump,
wherein the chemical comprises a tension-active chemical mixed into the well fluid mixture by the mixer.

32. A system usable with a well, comprising:
a pump comprising a motor and a reservoir to receive a lubricant for the motor; and
a mechanism to establish a bleed path between the reservoir and a well fluid flowpath of the pump to communicate the lubricant into the flowpath.

33. The system of claim 32, wherein the communication of lubricant into the flowpath prevents corrosion of the pump.

34. The system of claim 32, further comprising:
a chemical injection line to communicate the lubricant to the reservoir.

35. The system of claim 32, further comprising:
a pressure compensator to regulate communication of the lubricant to the reservoir.

36. The method of claim 32, further comprising:
regulating a pressure of the lubricant in the reservoir to control communication of the lubricant into the reservoir.

37. A method usable with a well, comprising:
communicating a lubricant into a reservoir of a pump to lubricate a motor of the pump; and
establishing a bleed path between the reservoir and a well fluid flowpath of the pump to communicate the lubricant into the flowpath.

38. The method of claim 37, wherein the communication of lubricant into the flowpath prevents corrosion of the pump.

39. The method of claim 37, further comprising:
communicating the lubricant to the reservoir through a chemical injection line.

40. The method of claim 37, further comprising:
regulating the communication of the lubricant into the flowpath to enhance a flow through the well fluid flowpath.

41. A method usable with a well, comprising:
injecting a chemical through a chemical injection line into a well fluid flow that passes through a well pump;
controlling the injecting to enhance the flow when passing through the pump; and
heating the flow to enhance reaction of the chemical with the flow.

42. The method of claim 41, wherein the injecting comprises injecting the chemical upstream a well fluid inlet of the pump.

43. The method of claim 41, wherein the controlling comprises controlling the injecting to reduce instability of a well mixture flowing through the pump caused by a gas-to-liquid ratio of the mixture.

44. The method of claim 41, wherein the controlling comprises controlling the injecting to reduce dynamic viscosity of a petroleum liquid phase of a well fluid mixture flowing through the pump.

45. The method of claim 41, wherein the controlling comprises controlling the injecting to inhibit the formation of a product in the pump.

46. The method of claim 41, further comprising:
monitoring a flow through the pump,
wherein the controlling occurs in response to the monitoring.

47. The system of claim 46, wherein the circuit comprises at least one sensor to monitor a flow through the pump, and the circuit controls the injection in response to the monitoring of the flow.

48. The system of claim 47, wherein the circuit controls the injection to reduce dynamic viscosity of a petroleum liquid phase of a well fluid mixture flowing through the pump.

49. The system of claim 48, wherein the circuit controls the injection to reduce instability of a well mixture flowing through the pump caused by gas-to-liquid of the mixture.

50. A system usable with a well, comprising:
a pump to establish a flow through the well;
a chemical injection line to inject a chemical into the flow upstream of the pump;
a circuit to control the injection of the chemical to enhance a flow through the pump; and
a heater to heat fluid flowing into the pump to enhance reaction of the chemical with the fluid.

51. The system of claim 50, wherein the chemical injection line injects the chemical near a well fluid inlet of the pump.

52. A method usable with a well, comprising:
injecting a chemical through a chemical injection line into a well fluid flow that passes through a well pump;
controlling the injecting to enhance the flow when passing through the pump; and
routing the chemical line to a subsea flow booster,
wherein the pump is part of the booster.

53. The method of claim 52, wherein the injecting comprises injecting the chemical upstream a well fluid inlet of the pump.

54. The method of claim 52, wherein the controlling comprises controlling the injecting to reduce instability of a well mixture flowing through the pump caused by a gas-to-liquid ratio of the mixture.

55. The method of claim 52, wherein the controlling comprises controlling the injecting to reduce dynamic viscosity of a petroleum liquid phase of a well fluid mixture flowing through the pump.

56. The method of claim 52, wherein the controlling comprises controlling the injecting to inhibit the formation of a product in the pump.

57. A system usable with a well beneath a seabed, comprising:

a pump to establish a flow through the well, the pump being part of a subsea flow booster;

a chemical injection line to extend to the subsea flow booster to inject a chemical into the flow upstream of the pump; and a circuit to control the injection of the chemical to enhance a flow through the pump.

58. The system of claim 57, wherein the chemical injection line injects the chemical near a well fluid inlet of the pump.

59. The system of claim 57, wherein the circuit controls the injection to reduce instability of a well mixture flowing through the pump caused by gas-to-liquid of the mixture.

60. The system of claim 57, wherein the circuit controls the injection to reduce dynamic viscosity of a petroleum liquid phase of a well fluid mixture flowing through the pump.

61. The system of claim 57, wherein the circuit controls the injection to inhibit the formation of a product in the pump.

* * * * *